United States Patent [19]

Bevington et al.

[11] Patent Number: 4,519,112

[45] Date of Patent: May 28, 1985

[54] MUFFLED VACUUM CLEANER

[75] Inventors: John F. Bevington; Paul Meeker, both of Toledo; Michael Savidge, Oregon, all of Ohio

[73] Assignee: The National Super Service Company, Maumee, Ohio

[21] Appl. No.: 549,067

[22] Filed: Nov. 7, 1983

[51] Int. Cl.[3] ..... A47L 9/14

[52] U.S. Cl. ..... 15/326; 15/347; 15/353; 55/379; 55/DIG. 3

[58] Field of Search ..... 15/326, 350, 351, 347, 15/353; 181/247, 249, 255; 55/276, 418, DIG. 3, 379

[56] References Cited

U.S. PATENT DOCUMENTS

| | | | |
|---|---|---|---|
| Re. 21,847 | 7/1941 | Bernfeld | 55/379 X |
| Re. 22,370 | 9/1943 | Cummings . | |
| 659,440 | 10/1900 | Farquhar | 15/353 X |
| 963,139 | 7/1910 | Griffiths | 55/325 |
| 1,011,989 | 12/1911 | Mohr | 15/350 |
| 1,157,242 | 10/1915 | Matchette | 55/379 X |
| 1,230,827 | 6/1917 | Duffie | 15/351 |
| 1,698,725 | 1/1929 | Kirby | 15/347 X |
| 1,729,103 | 9/1929 | Gasner et al. | 55/1 |
| 1,887,600 | 11/1932 | Replogle | 15/355 |
| 1,962,370 | 6/1934 | Thor | 183/36 |
| 2,000,854 | 5/1935 | Leathers | 183/36 |
| 2,024,143 | 12/1935 | Cameron | 183/51 |
| 2,130,495 | 9/1938 | Hoover | 181/42 |
| 2,130,513 | 9/1938 | Smellie | 183/52 |
| 2,175,647 | 10/1939 | Replogle . | |
| 2,223,353 | 12/1940 | Demaree . | |
| 2,247,103 | 6/1941 | Summerson | 55/DIG. 3 |
| 2,342,905 | 2/1944 | Smellie | 183/42 |
| 2,539,195 | 1/1951 | Lang | 15/326 X |
| 2,607,067 | 8/1952 | Minerley | 15/320 |
| 2,784,800 | 3/1957 | Segesman | 183/43 |
| 2,809,389 | 10/1957 | Collins et al. | 15/339 |
| 3,150,405 | 9/1964 | Tissler | 15/351 |
| 3,297,233 | 1/1967 | Meyerhoefer | 229/53 |
| 3,322,041 | 5/1967 | Fesco | 93/35 |
| 3,330,099 | 7/1967 | Fesco | 55/367 |
| 3,350,858 | 11/1967 | Verhagen | 55/376 |
| 3,350,859 | 11/1967 | Fesco | 55/380 |
| 3,370,405 | 2/1968 | Fesco | 55/368 |
| 3,370,674 | 2/1968 | Jettinghoff | 181/54 |
| 3,417,550 | 12/1968 | Fesco | 55/376 |
| 3,619,989 | 11/1971 | Howard et al. | 55/368 |
| 3,639,939 | 2/1972 | Crener et al. | 15/320 |
| 3,675,268 | 7/1972 | Nordeen | 15/350 |
| 3,728,847 | 4/1973 | Howard | 55/371 |
| 3,882,961 | 5/1975 | Cannan et al. | 181/50 |
| 4,028,074 | 6/1977 | Schaaf | 55/366 |
| 4,084,948 | 4/1978 | MacFarland | 55/366 |
| 4,119,414 | 10/1978 | Smaling | 55/97 |
| 4,164,989 | 8/1979 | Lux et al. | 181/265 |
| 4,171,553 | 10/1979 | Stein | 15/350 |
| 4,418,443 | 12/1983 | Fischer | 15/326 |

FOREIGN PATENT DOCUMENTS

| | | | |
|---|---|---|---|
| 751881 | 7/1956 | United Kingdom | 181/249 |
| 1241012 | 3/1971 | United Kingdom | 15/353 |

*Primary Examiner*—Chris K. Moore

*Attorney, Agent, or Firm*—Hugh Adam Kirk

[57] ABSTRACT

This disclosure concerns primarily the filter dirt-collecting bag for a vacuum cleaner having a motor and motor-driven fan in a housing. The outlet from the fan projects outwardly and usually upwardly from the housing and is removably connected to the bottom of the flexible bag for collecting the dust, which bag substantially and preferably completely covers the housing like a pillow to muffle the mechanical noise from the motor and fan. Inside the bag is a tube, which may be non-porous and flexible, connected at its lower end directly to the fan outlet at the bottom of the bag and at its upper end to the top of the bag. Adjacent the upper end of this tube is connected an outwardly and downwardly extending tubular extension, spout or nozzle, for muffling the air noise from the fan and directing the dirt toward the bottom of the bag.

7 Claims, 4 Drawing Figures

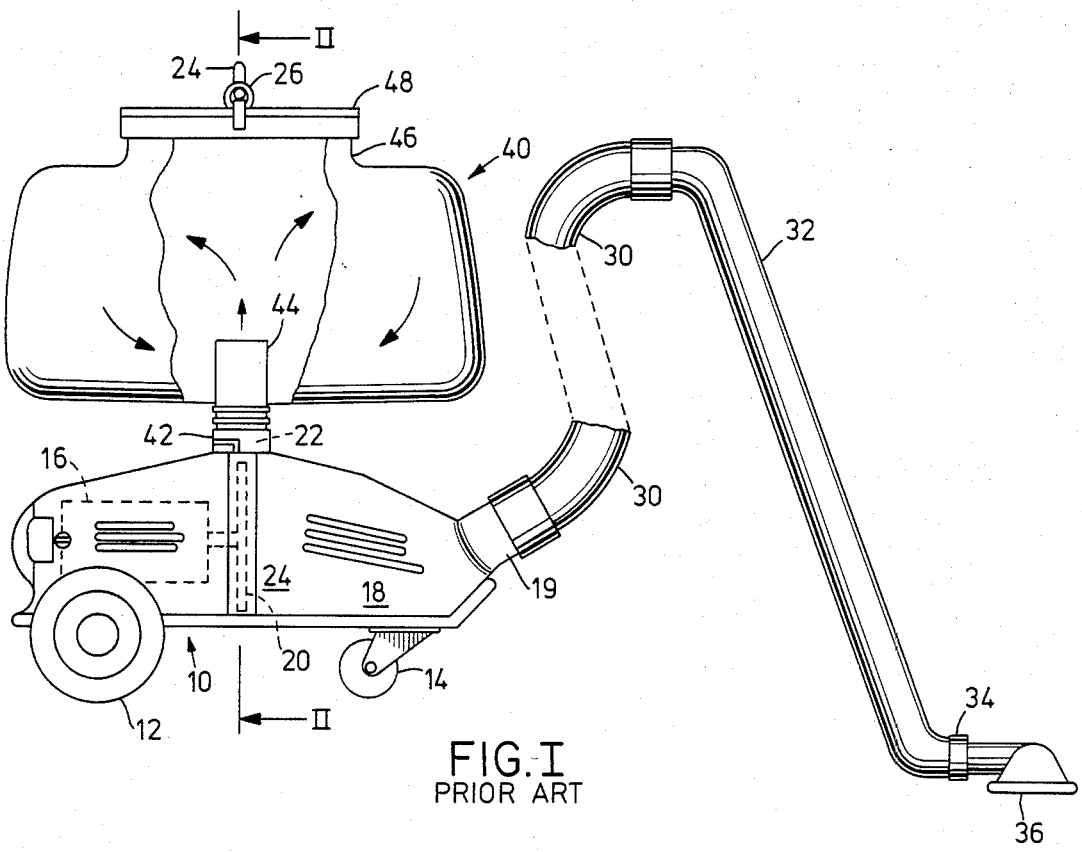
FIG. I
PRIOR ART
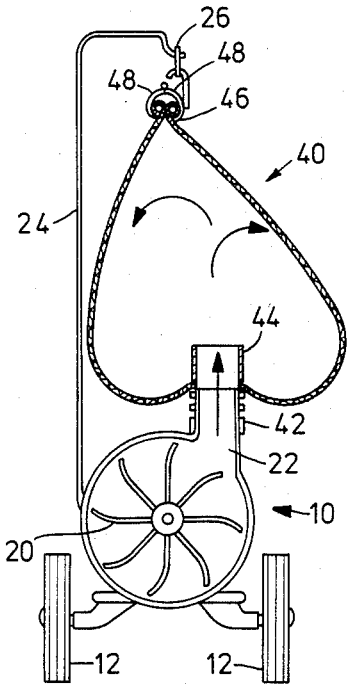
FIG. II
PRIOR ART

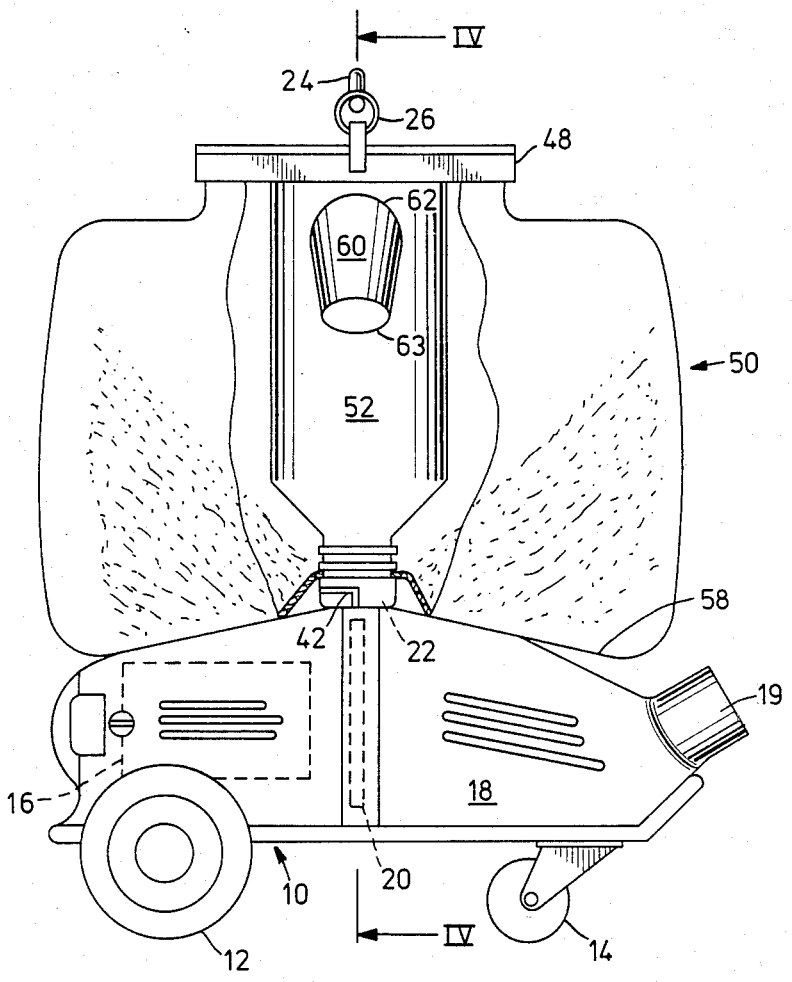
FIG. III

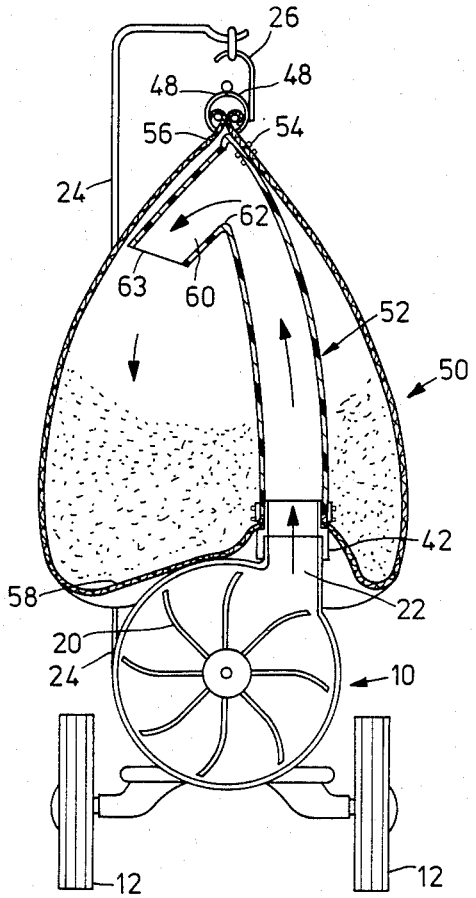
FIG. IV

MUFFLED VACUUM CLEANER

BACKGROUND OF THE INVENTION

Previously vacuum cleaners having a flexible dust-collecting bag connected to the outlet of a fan in a housing had the inlet of the bag symmetrically positioned on the outlet and the bag ballooned outwardly and upwardly by the air pressure from the fan and continuously agitated the dirt toward the top of the bag causing blooming of the dust so that anything contacting the outside of the bag could easily be marked with the fine dust which was blown out through the fine pores in the bag. Furthermore, the ballooning of the bag exposes considerable portions of the top of the housing for transmitting the mechanical noises from the motor and fan, as well as air noise from the fan and turbulence in the bag.

SUMMARY OF THE INVENTION

Generally speaking, the invention involves a new type of dust filter bag for a vacuum cleaner, which bag muffles the noise from the motor, fan and air from the fan.

The type of vacuum cleaner employing such a dust filter bag may comprise a housing on a carriage in which housing is provided a motor which drives a fan. The housing has a suction inlet and a blower outlet usually tangent to the periphery of the fan and directed upwardly from the housing. It is to this outlet that the bottom of the filter bag of this invention is removably connected, such as by a bayonet-type joint. This filter bag is made of a flexible porous fabric material which permits release of the air and collection of dirt and dust. This bag has an openable top so that the dust and dirt collected therein can be periodically removed or dumped from the bag. Previously, a relatively short tubular extension was connected to the fan outlet connection opening in the bottom of the bag, which short tubular extension prevented the dust from falling out this bottom opening when the bag was removed for dumping or emptying.

The features of this invention are directed to the specific structure of the flexible filter bag which herein has a truncated rectangular pyramid shape, the bottom of which has the largest horizontal cross-sectional area and also has the opening for connection to the fan outlet. This opening is off-center of the bottom so that the bag completely covers the housing. Preferably at least the bottom of the bag is sufficiently large that as dirt accumulates therein it will sag and droop over the sides of the housing and muffle the mechanical noises of the motor and fan from the housing as a pillow would do if placed over the housing.

Inside the bag there is a muffler tube of an inverted J-shape which has its lower end connected to the opening in the bottom of the bag for the fan outlet and its upper end connected to the top of the bag adjacent the openable top thereof. Adjacent the top of the tube there is provided an outwardly and downwardly extending portion or extension like a nozzle or spout, which not only reverses the flow of the air in the tube but directs it and the dirt toward the bottom of the bag to reduce the agitation of the dirt in the bag and reduce blooming. This tube and its spout may be flexible or rigid, porous or non-porous, and preferably has a smooth inner surface to avoid the accumulation of dust and dirt therein.

OBJECTS AND ADVANTAGES

Accordingly it is an object of this invention to produce a simple, efficient, effective, economic muffled vacuum cleaner.

Another object is to produce a noise- and bloom-reducing dust filter bag for a vacuum cleaner.

Still another object is to produce a filter bag for a vacuum cleaner which fills from the top so that it can hold more dirt and does not have to be emptied as often, and also produces less back-pressure permitting more suction for better, faster and easier cleaning.

A further object is to produce a filter bag for a vacuum cleaner which reduces the turbulence of dust in the bag and correspondingly reduces blooming of dust from the bag.

BRIEF DESCRIPTION OF THE VIEWS

The above mentioned and other features, objects and advantages, and the manner of attaining them are described more specifically below in reference to the embodiment of this invention shown in the accompanying drawings wherein:

FIG. I is a side elevation of one type of a vacuum cleaner for which the muffled bag of this invention may be adapted, but showing a prior art bag with part thereof broken away to show the interior thereof;

FIG. II is a vertical sectional view taken along line II—II of FIG. 1 showing the fan and the prior art bag employed thereon;

FIG. III is a view similar to FIG. I showing a bag according to a preferred embodiment of the present invention with a part broken away showing the muffler tube inside the bag; and FIG. IV is a section taken along line IV—IV of FIG. III through inverted J-shaped muffler tube in the bag.

DETAILED DESCRIPTION OF PREFERRED EMBODIMENT

A. Prior Art Vacuum Cleaner Machine

Referring to all of the figures, there is shown an example of a vacuum cleaner machine to which the dust-collecting bag of this invention may be adapted. This machine comprises a housing 10 to the bottom of which are shown mounted wheels 12 and castors 14, and inside one end of the housing 10 is an electric motor 16 driving, centrally of the housing, a fan 20, and at the other end of the housing 10 a suction chamber 18 for collecting heavy particles such as metal to prevent their entrance into and damaging the fan 20. At the other end of the housing and directly connected to the suction chamber 18 is the suction inlet 19 to which there is connected a portion of a flexible hose 30 (see FIG. 1), the outer end of which is removably connected to a tubular wand 32, the outer end of which wand 32 may be connected via swivel 34 to any one of a plurality of suction tools 36, such as for cleaning carpets, crevises, furniture, shelves, counters, upholstery, etc.

Peripherally of the fan 20 is its air outlet duct 22 which extends upwardly from the housing along one side thereof as shown in FIGS. II and IV. To the outer open or upper end of this duct 22 is removably connected the dust-collecting filter bag 40 of the type known in the prior art shown in FIG. I and II. This bag 40 is provided with a removable connection, such as a bayonet-type fitting 42. This fitting for the prior art bag had a relatively short tube 44 which, as shown in FIGS.

I and II, extends less than about a third of the way into the bag 40, so that when the bag 40 is removed the dirt collected therein will not fall out this opening connection in its bottom. The upper end of the bag 40 is provided with an openable top 46, which opening is normally closed by a pair of parallel clamping bars 48 suspended by a hook and link means 26 supported by a rod 24 extending upwardly from the housing 10. When the prior art bag 40 is ballooned by the air pressure from the outlet duct 22 from the fan 20, this short tube 44 causes the dust in the bag to be continuously agitated as shown by the arrows inside the bag 40. Also the prior art bag 40 is shown to be symmetrically placed over the outlet 22 above and to one side of the housing as shown in FIG. II.

B. The Muffled Dirt-Collecting Filter Bag

Referring now to the improved muffled bag 50 of this invention shown in FIGS. III and IV, the tube 44 shown in the prior art bag 40 of FIGS. I and II is replaced by an inverted J-shaped flexible muffle tube 52, the lower end of which is attached to the opening in the bottom of the bag 50 around the removable connection fitting 42. The upper end of the tube 52 is attached at 54 to the top of the bag 50 adjacent the opening 56 therein (see FIG. IV). Adjacent the top of the tube 52 there is provided an outwardly and downwardly extending tubular extension, nozzle, or spout 60, the larger end 62 of which is connected to a similar-sized aperture adjacent the upper end of the tube 52. The outer smaller end 63 of the extension or spout 60 is angled at least slightly downwardly from the horizontal, or at least 110° from the vertical longitudinal axis of the tube 52, so as to direct the dirt in the air outlet toward the bottom of the bag 50. This spout 60 may have a completely reversed bend up to 180° from this longitudinal axis of the tube 50, but generally it is between about 120° and 160°. As the bag is inflated and air is forced up through the flexible muffler tubes 52 and 60, the angle between them tends to decrease. The tubes 52 and 60 are preferably made of vinyl and have a smooth interior surface so as to prevent the collection of dust therein.

Furthermore, the bag 50 is larger than the bag 40 and has a larger base with the aperture in its bottom offset to one side so that its bottom 58 substantially completely covers the top of the housing 10, and as dirt accumulates in the bag 50 its bottom sags and droops downwardly along the sides of the housing. Thus the larger bag 50 with its larger bottom when filled with dust and dirt tends to act as a pillow on top of the housing 10 to muffle the mechanical noises from the motor 16 and fan 20. As shown by dots in the bag 50 in FIGS. III and IV, the dust particles tend to build up in the bag first in the bottom and then up the sides and there is relatively little turbulent flow of the type disclosed in the prior art bag 40 shown by the arrows in FIGS. I and II. Thus, the tubes 52 and 60 which direct the dirt toward the bottom of the bag 50 reduces the blooming along the sides and upper portion of the bag 50 so that dust does not penetrate through the bag quite as easily when it is contacted by ones clothes or outside material or objects. The ballooning of the bag 60 however does tend to raise it above the housing 10, particularly when the bag is empty, however it is not usually long in a position where it does not aid in muffling the mechanical noise from the motor 16 and the fan 20.

By comparative tests it has been found that the amount of noise in decibels which are emitted at a distance of six feet from the vacuum cleaner machine shown in FIGS. III and IV is about three to six decibels less than that from the same machine with the bag 40 as shown in prior art FIGS. I and II. This means that the bag 50 of this invention produces at least a hundred percent reduction in the noise emitted from the vacuum cleaner machine.

It should be clearly understood that the materials of which the bag 50 and the muffler tube 52 and its extension 60 are fabricated, may vary provided the bag 50 has sufficient porosity to permit the escape of the air necessary for operation of the vacuum cleaner and still have small enough pores to collect the dust and dirt blown therein. Furthermore, it is desirable that the tubes 52 and 60 have smooth interior surfaces to avoid the accumulation of dust thereon.

While there is described above the principles of this invention in connection with specific apparatus, it is to be clearly understood that this description is made only by way of example and not as a limitation to the scope of this invention.

We claim:

1. A muffled vacuum cleaner comprising:

(1) a motor and motor-driven fan in a housing, (2) an outlet from said fan directed upwardly from said housing, (3) a dirt-collecting flexible porous bag removably connected at its bottom to said outlet, (4) a flexible non-porous tube in said bag connected at its lower end to the connection of said bag to said outlet, and connected at its upper end to the top of said bag, said tube having adjacent its top a tubular extension that extends outwardly and downwardly at at least 100° with the longitudinal vertical axis of said tube, said extension having a first end of larger cross-sectional area than the second end, said larger cross-sectional area end being connected to a correspondingly large opening in said tube, whereby said tube and its extension in said bag muffles the air noise from said fan.

2. A muffled vacuum cleaner according to claim 1 wherein said tube and tubular extension form an inverted J-shaped tube that extends to the upper portion of said bag through the dirt that accumulates in said bag.

3. A muffled vacuum cleaner according to claim 1 wherein said tube has a smooth interior surface to reduce dirt collection thereon.

4. A muffled vacuum cleaner according to claim 1 wherein said bag has its largest horizontal cross-section adjacent its base around its said connection to said outlet for substantially completely covering said housing, and drooping over its sides, as a pillow, when dirt accumulates in said bag, whereby said bag muffles the mechanical noise from said motor and fan.

5. A muffled vacuum chamber comprising:

(1) a motor-driven fan in a housing, (2) an outlet from said fan directed upwardly from said housing, (3) a dirt-collecting bag removably connected at its bottom to said outlet, said bag having its largest horizontal cross-section adjacent its bottom around its said connection to said outlet for substantially completely covering said housing, whereby said bag muffles the mechanical noise from said motor and fan, and (4) a flexible non-porous tube in said bag connected at its lower end to the bottom of said bag to the connection of said bag to said outlet, and connected at its upper end to the top of said bag, said tube having connected adjacent its upper end a tubular extension that extends outwardly and downwardly at at least 100° with the longitudinal vertical axis of said tube, said extension having a first end of larger cross-sectional area than the second end, said large cross-sectional area end being connected to a correspondingly large opening in said tube, whereby said tube and its extension in said bag muffles the air noise from said fan.

6. In a vacuum cleaner having a motor-driven fan in a housing, an outlet from said fan directed upwardly from said housing, and a dirt-collecting flexible porous bag removably connected to said outlet, the improvement comprising:

(1) a flexible non-porous tube in said bag connected at its lower end to the bottom of said bag and said outlet, and connected at its upper end to the top of said bag, said tube having adjacent its upper end a flexible non-porous nozzle portion extending outwardly and downwardly at at least 100° with the longitudinal vertical axis of said tube, said nozzle having a first end of larger cross-sectional area than the second end, said larger cross-sectional area end being connected to a correspondingly large opening in said tube, whereby said tube and its nozzle extension in said bag muffles the air noise from said fan, and (2) said bag having its largest horizontal cross-section adjacent its bottom around its connection to said outlet for substantially completely covering said housing and drooping over its sides as a pillow when containing dirt, whereby said bag muffles the mechanical noise from said motor and fan.

7. A vacuum cleaner according to claim 6 wherein said tube and nozzle portion have a smooth interior surface to reduce dirt collection thereon.

* * * * *